United States Patent [19]

Knutsen

[11] Patent Number: 4,492,044

[45] Date of Patent: Jan. 8, 1985

[54] POCKET VENTILATION ROLL BAFFLE ASSEMBLY

[75] Inventor: Daniel P. Knutsen, Pasco, Wash.

[73] Assignee: Boise Cascade Corporation, Boise, Id.

[21] Appl. No.: 524,569

[22] Filed: Aug. 19, 1983

[51] Int. Cl.[3] ..... F26B 11/02

[52] U.S. Cl. ..... 34/114; 34/116; 34/123

[58] Field of Search ..... 34/114, 116, 123, 68, 34/115

[56] References Cited

U.S. PATENT DOCUMENTS

| | | | |
|---|---|---|---|
| 3,002,290 | 10/1961 | Abdoo | 34/123 |
| 3,702,503 | 11/1972 | Nichols | 34/114 |
| 3,716,926 | 2/1973 | Stievenart | 34/114 |
| 4,346,523 | 8/1982 | Bonning | 34/68 |

*Primary Examiner*—Edward G. Favors
*Assistant Examiner*—Steven E. Warner
*Attorney, Agent, or Firm*—Laubscher, Philpitt & Laubscher

[57] ABSTRACT

A pocket ventilation roll baffle assembly adapted for use in drying a paper web is disclosed. The pocket ventilation roll includes a stationary tubular inner core roll, a tubular outer shell roll mounted for rotation in concentrically spaced relation about the inner core roll, and a device for supplying drying air within the inner core roll. The drying air flows longitudinally through the inner core roll and radially outwardly through an arcuate portion of longitudinally arranged perforations contained in the inner core roll and circumferential perforations contained in the outer shell roll. The pocket ventilation roll baffle assembly includes a baffle arrangement for adjusting the profile of the drying air flowing radially outwardly from the pocket ventilation roll. The baffle arrangement includes a central shaft mounted longitudinally within the inner core roll, a plurality of air-deflecting baffles pivotally connected with the shaft at longitudinally spaced intervals, and a device for positioning the baffles at given angular positions relative to the shaft.

7 Claims, 16 Drawing Figures

PRIOR ART

POCKET VENTILATION ROLL BAFFLE ASSEMBLY

SPECIFICATION

BACKGROUND OF THE INVENTION

The present invention relates to a pocket ventilation roll baffle assembly for use in drying a newly formed paper web.

BRIEF DESCRIPTION OF THE PRIOR ART

It is known in the papermaking art to provide pocket ventilating rolls for ventilating the dryer pockets formed between the paper webs and the drying rolls, thereby to produce a uniform humidity profile, and additional drying capacity. One known manufacturer of such pocket ventilating rolls is the Beloit Corporation of Beloit, Wisconsin.

One problem encountered in such a drying apparatus is the development of an uneven cross-machine moisture profile which causes uneven drying of the paper webs.

It has been determined, however, in actual use of the pocket ventilation rolls, that the radially outward air flow steadily increases along the length of the roll from the air inlet end. This increase in air flow along the length of the roll results in a sharply slanted air profile and causes the non-uniform drying of the felts and paper webs. Moreover, it has been discovered that the drying air flows transversely away from the air inlet end in the area between the inner and outer rolls. The edge portions of the web must therefore be overdried in order for the center portion of the web to be sufficiently dry, while on the other hand, in order to prevent the edge portions of the web from overdrying, the center portion cannot be adequately dried. Thus, great waste results from the portions of a paper web which are not evenly dried to the correct moisture content.

The present invention was developed to avoid the above and other drawbacks of the known paper web drying apparatus.

SUMMARY OF THE INVENTION

Accordingly, it is a primary object of the present invention to provide a pocket ventilation roll baffle assembly for use in the drying apparatus of a paper machine, including means for adjusting the profile of drying air flowing radially outwardly from the pocket ventilation roll, whereby a uniform air profile may be established to promote uniform ventilation of the pocket areas and uniform drying of a paper web.

It is a further object of the present invention to provide a pocket ventilation roll baffle assembly which may be installed in a drying apparatus during the operation of the papermaking machine.

More particularly, the pocket ventilation roll baffle assembly of the present invention includes a central shaft adapted for mounting in spaced relation longitudinally within the inner core roll of the pocket ventilation roll, a plurality of air-deflecting baffle members which are pivotally connected with the shaft at longitudinally spaced intervals for pivotal movement about parallel horizontal axes contained in planes normal to the axis of the shaft, respectively, and means for positioning the baffle memters at given angular positions relative to the shaft, respectively.

BRIEF DESCRIPTION OF THE DRAWING

Further objects and advantages of the present invention will become apparent from a study of the following detailed description when viewed in light of the accompanying drawing, in which.

DETAILED DESCRIPTION

Figure 1:
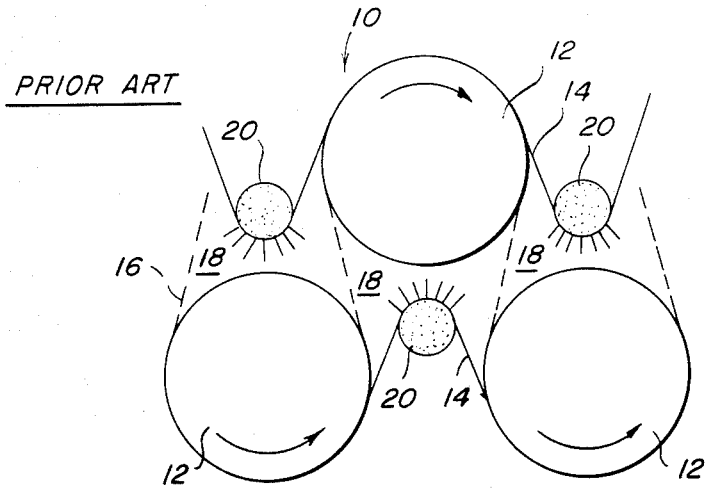
FIG. 1 is a front elevation view of a portion of a drying apparatus of the prior art.

As shown in FIG. 1, one type of conventional paper machine includes a paper web drying apparatus 10 having a plurality of drying rolls 12 and felt webs 14 for moving a paper web 16 which is received from a web forming apparatus (not shown) through the drying apparatus. One problem encountered in such a drying apparatus is the development of an uneven cross-machine moisture profile which causes uneven drying of the paper webs. One factor which contributes to the uneven moisture profile is the non-uniform humidity profiles which develop in the dryer pocket areas 18 defined by the paper web 16 and the drying rolls 12. Pocket ventilation rolls 20 are provided for ventilating the pocket areas 18, respectively, in order to produce a uniform humidity profile and improve drying uniformity. The pocket ventilation rolls also assist in drying the moving felts 14.

Figure 2:
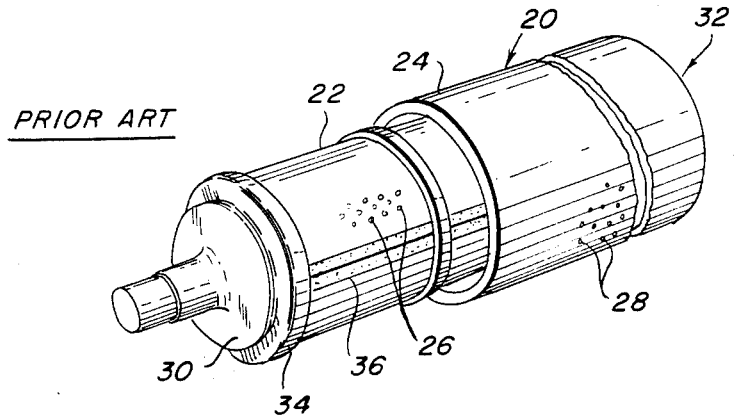
FIG. 2 is a side perspective view of a pocket ventilation roll of the prior art.
Figure 4:
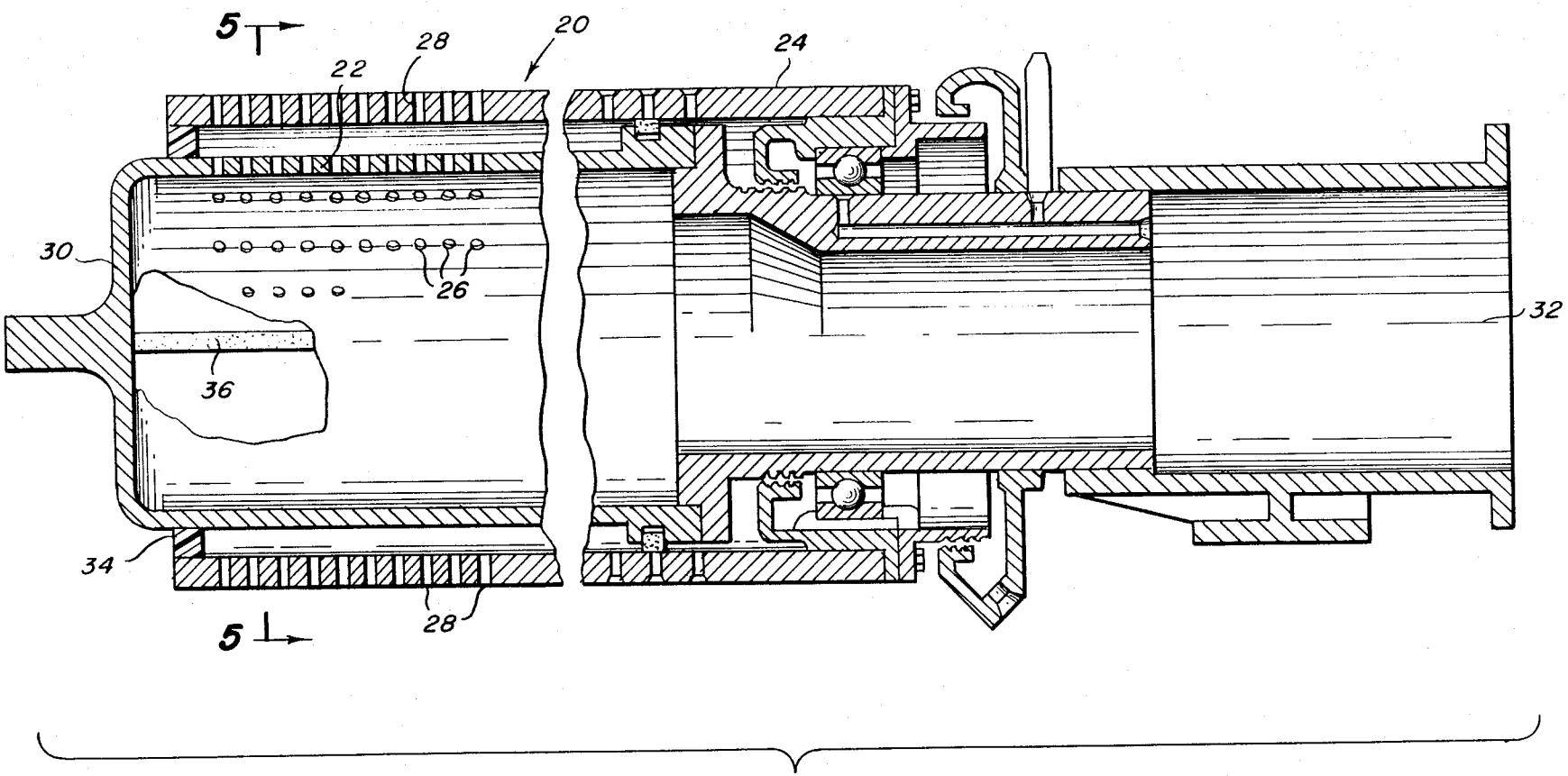
PRIOR ART Fig. 4
FIG. 4 is a longitudinal cross sectional view of a pocket ventilation roll of the prior art.
Figure 5:
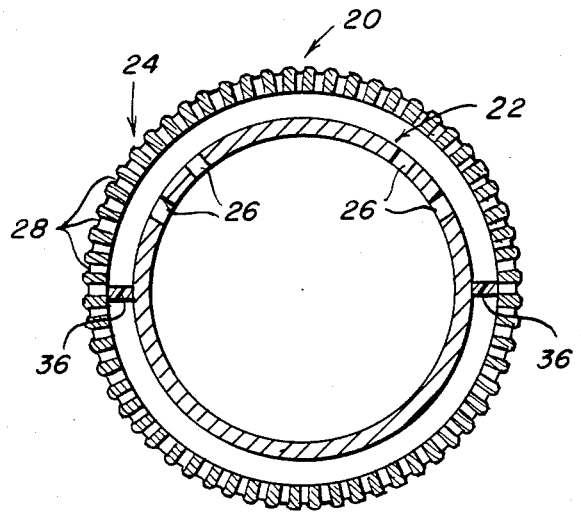
FIG. 5 is a cross sectional view taken along line 5—5 in the pocket ventilation roll of FIG. 4.

A conventional pocket ventilation roll 20 is shown in FIGS. 2, 4, and 5 and includes a stationary horizontal tubular inner core roll 22, and an outer tubular shell roll 24 mounted for rotation in concentrically spaced relation about the inner core roll 22. An arcuate portion of the inner core roll 22 adjacent the corresponding dryer pocket area 18 contains a plurality of longitudinally arranged perforations 26 while the outer shell roll 24 contains circumferential perforations 28 throughout its length. The inner core roll is closed at one end 30 and open at its other end 32, whereby hot air flow may be directed into the interior of the inner core roll through the narrowed air inlet end 32. Circumferential seal 34 and longitudinal seals 36 are provided between the inner and outer rolls, whereby air flows longitudinally through the inner core roll and radially outwardly through the perforations 26 of the inner core roll and 28 of the outer shell roll. The seals 34 and 36 assist in confining the hot air to the dryer pocket areas.

Figure 3:
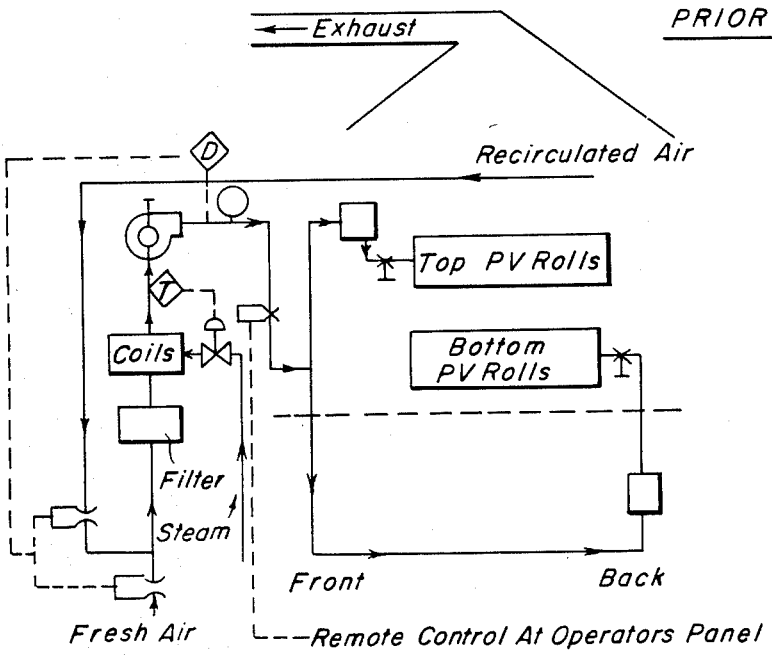
FIG. 3 is a schematic representation of a prior art air supply system for a pocket ventilation roll device.

FIG. 3 discloses a schematic representation of the air flow of the conventional pocket ventilation roll wherein air is filtered and heated before being introduced into the pocket ventilation rolls. In one embodiment, the upper rolls are arranged with the air intake ends on the front side of the drying apparatus, while the bottom rolls are arranged with the air intake ends on the back side of the drying apparatus. The hot air dries the felts and flows into the pocket areas to remove water vapor therefrom and improve the rate of moisture evaporation.

Figure 6:
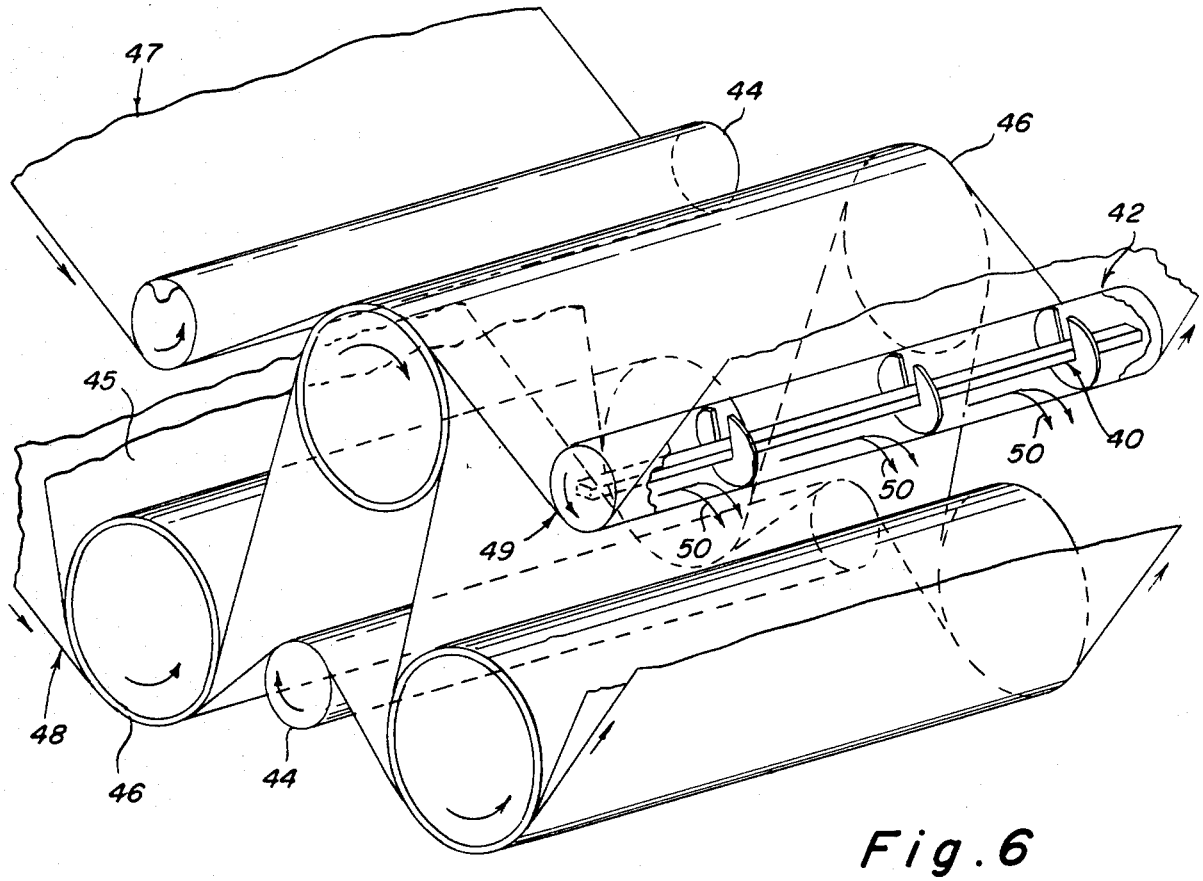
FIG. 6 is a front perspective view of a drying apparatus including the pocket ventilation baffle assembly of the present invention.

The pocket ventilation roll baffle assembly is shown generally in FIG. 6 installed in a drying apparatus of a papermaking machine. More particularly, the baffle assembly 40 is mounted in the interior of the inner core roll of the pocket ventilation roll 42. Similar pocket ventilation rolls 44 also have the baffle assemblies of the present invention mounted therein. The paper web 45 is moved over drying rolls 46 by means of the upper and lower moving felts 47, 48, respectively.

Hot air is directed through the open air inlet end of the pocket ventilation rolls, for example through air inlet end 49 of roll 42 and flows radially outwardly through the perforations contained in the inner core and outer shell rolls, as shown by arrows 50. The baffle assembly 40 of the present invention adjusts the radially outward flow of air such that a uniform air profile along the length of the pocket ventilation roll is established, whereby uniform drying of the pocket area, felt and paper web is accomplished.

Figure 7:
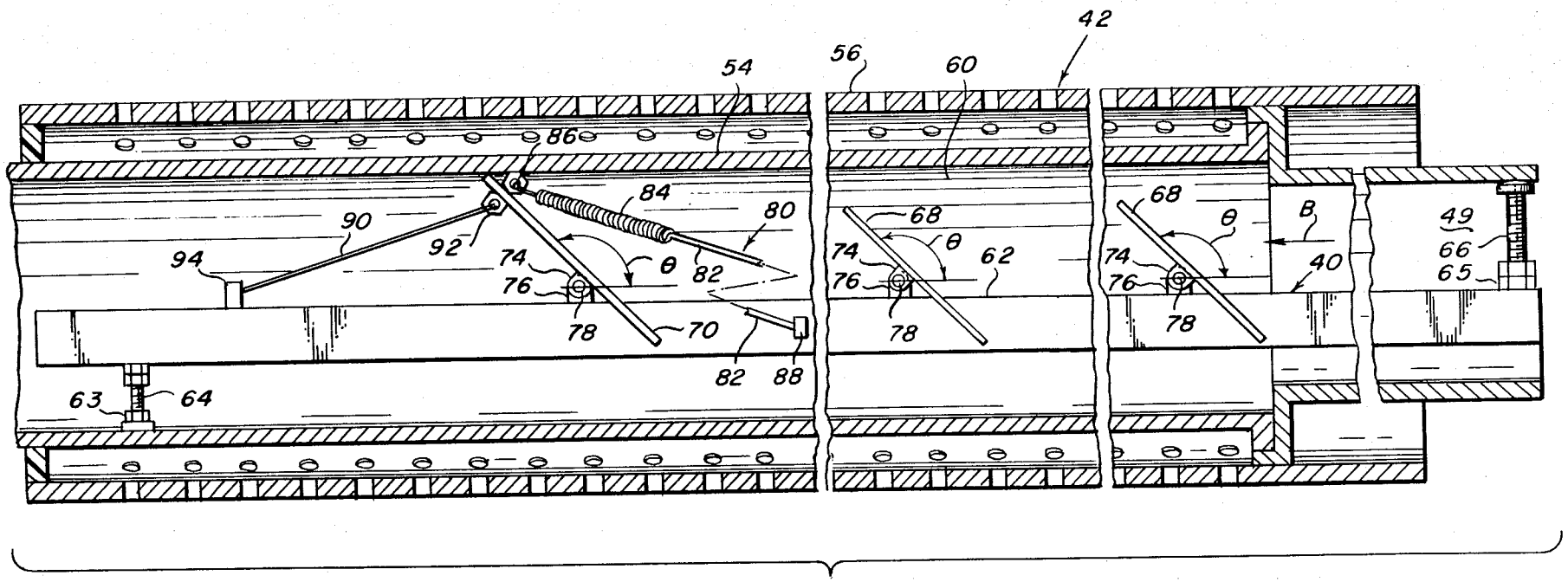
FIG. 7 is a longitudinal sectional view of the baffle assembly of the present invention mounted in a pocket ventilation roll.
Figure 8:
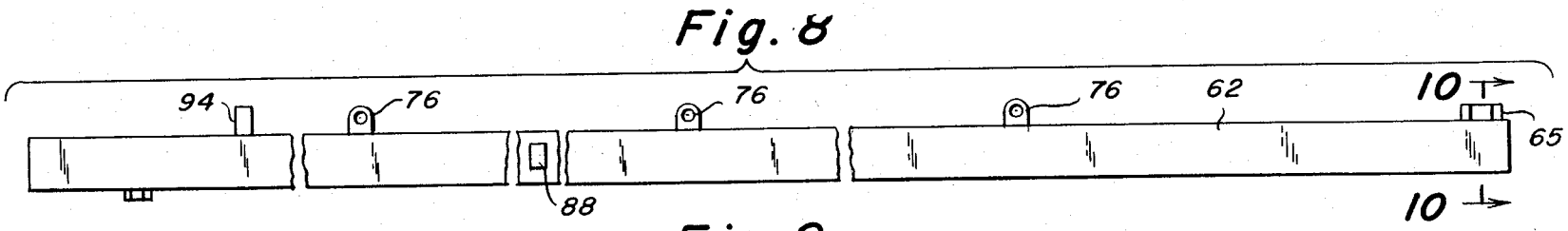
FIGS. 8 and 9 are front and top elevation views, respectively, of the shaft member of the baffle assembly.
Figure 9:
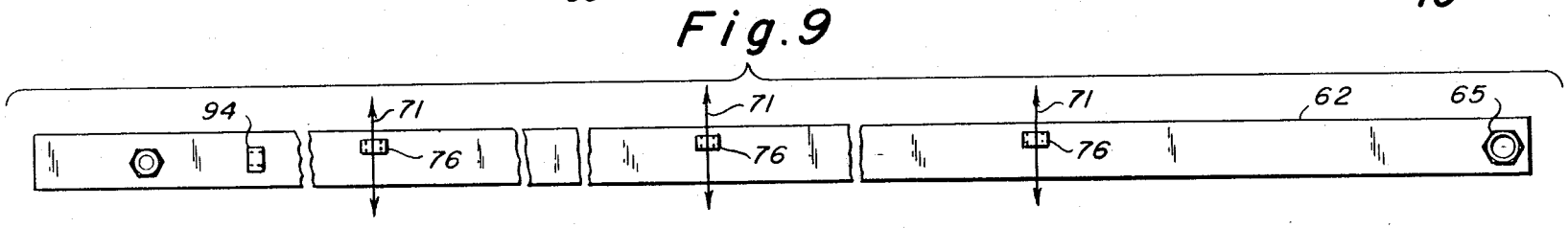
Figure 12:
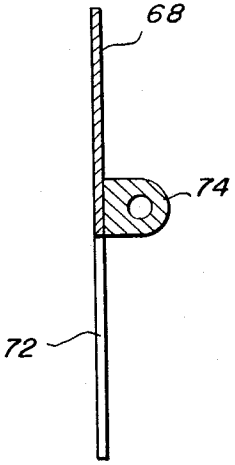
FIGS. 12 and 14 are cross-sectional views taken along lines 12—12 and 14—14, respectively, of the baffle members of FIGS. 11 and 13, respectively.

The baffle asembly of the present invention is disclosed in detail in FIGS. 7–14. With reference first to FIG. 7, the baffle assembly 40 is mounted in the interior of a conventional pocket ventilation roll 42. The roll 42 comprises an inner core roll 54 and outer shell roll 56 and is similar to the pocket ventilation roll 20 disclosed in FIGS. 2, 4 and 5. The air inlet end 49 has a smaller diameter relative to the main portion 60 of the inner core roll.

The baffle assembly 40 includes a central shaft member 62 adapted for mounting in spaced relation longitudinally within the inner core roll 54. The shaft 62 preferably is of a square cross-section as disclosed in FIG. 10, hollow, and formed of steel. In order to appropriately fit, one type of conventional pocket ventilation roll, the shaft member is approximately 18.5 feet in length. The shaft member is mounted at the closed end of the inner core roll by means of a nut and bolt 63, 64, respectively, and at the narrowed air inlet end 58 by means of a nut and bolt 65, 66, respectively. Since the shaft 62 is mounted on the stationary inner core roll 54, the baffle assembly may be installed during operation of the drying apparatus, and no machine down-time is required.

The baffle assembly 40 further includes a plurality of air-deflecting baffle members 68 and 70 which are pivotally connected to the shaft 62 at longitudinally spaced intervals. The baffle members are adapted for pivotal movement about respective parallel horizontal axes, represented by lines 71 in FIG. 9, which are contained in planes normal to the axis of the shaft 62, whereby the baffle members may be pivoted to a desired air-deflecting position. Each of the baffle members 68, 70 comprises a flat plate, preferably made of steel, containing a slot 72 (see FIGS. 11 and 13) for receiving the shaft 62. The axis of the slot 72 extends normal to the associated baffle pivot axis.

Figure 11:
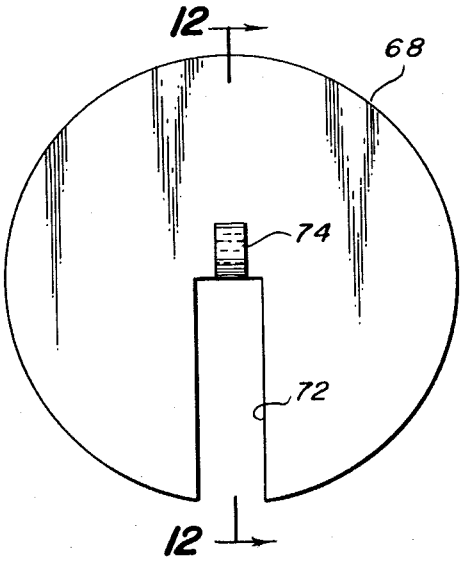
FIGS. 11 and 13 are front elevation views of the circular and eliptical baffle members, respectively, of the baffle assembly.
Figure 10:
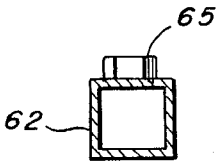
FIG. 10 is a cross-sectional view of the shaft member taken along line 10—10 of FIG. 8.
Figure 13:
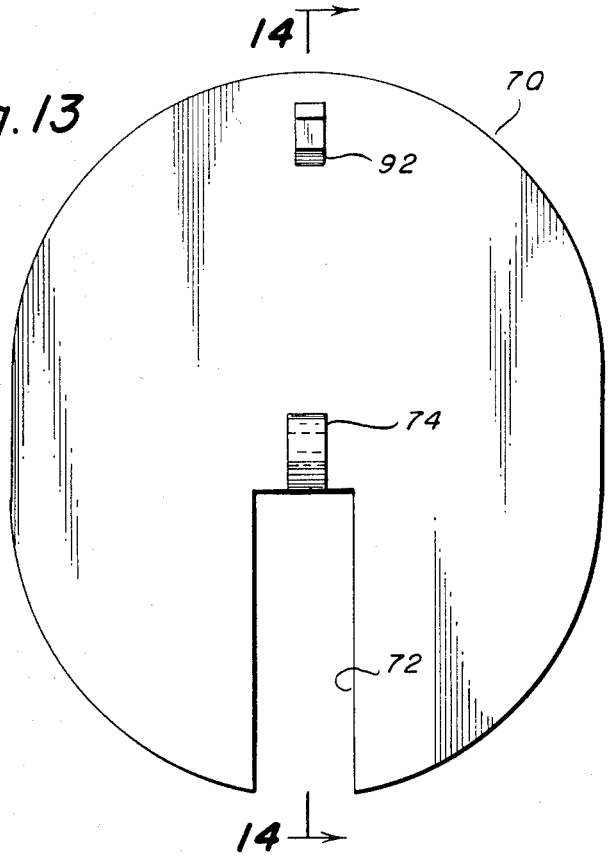
Figure 14:
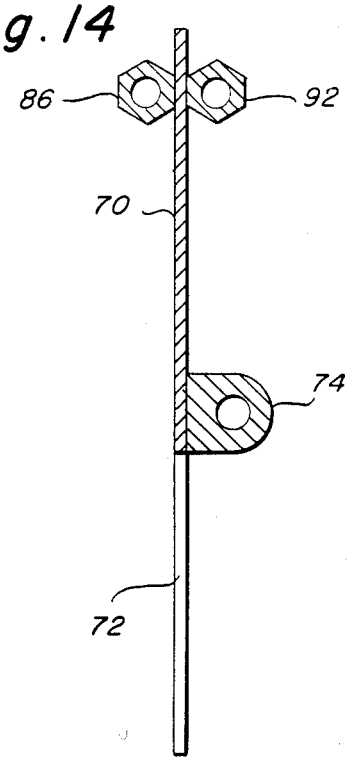

At least one of the baffle members is of a circular configuration, as shown by baffles 68 in FIGS. 7 and 11. Moreover, it is desirous to include at least one baffle member which has an elliptical configuration as shown by baffle 70 in FIGS. 7 and 13. It is further preferable that the baffle member which is located furthermost from the air inlet end 49 of the pocket ventilation roll is larger than the remaining baffle members and is of a sufficient size to substantially block the longitudinal flow of air through the inner core roll. In the preferred embodiment of FIG. 7, the larger baffle member is the eliptical baffle member 70.

The baffle members are connected with the shaft 62 by means of hinge members 74 and 76, wherein a hinge member 74 is mounted on each baffle member and hinge members 76 are mounted on the shaft 62 at longitudinally spaced intervals which correspond with the spaced intervals between the baffle members. A hinge pin 78 is inserted through aligned apertures in hinge members 74 and 76 to connect a baffle member with the shaft.

The baffle assembly further includes means for positioning and holding the baffle members at given angular air-deflecting positions relative to the shaft member. More particularly, in order to establish a uniform radially outward air flow from the pocket ventilation roll, it is preferred that the baffle members be positioned such that the given angular air-deflecting position $\theta$ for each baffle member is an obtuse angle relative to the direction of the longitudinal flow of drying air through the inner core roll, represented by arrow B.

In the case of the smaller baffle members which, when in position on the shaft can fit through the narrowed air inlet end 49 of the pocket ventilation roll, a tightening nut (not shown) is provided on the hinge pin 78 to serve as the positioning and holding means. Thus, prior to the mounting of the assembly in the pocket ventilation roll, baffle members 68 are connected with the shaft and pivoted to the desired position, and the tightening nuts are mounted on the hinge pins 78 and tightened to hold the baffle members at the desired angular positions. The assembly may then be inserted and mounted in the pocket ventilation roll. Baffle members 68 include this type of positioning and holding means.

In the case of larger baffle members, for instance the furthermost baffle member 70, which, when in position on the shaft cannot fit through the narrowed air inlet end 49, the positioning and holding means includes a resilient means 80 for biasing the baffle member in a direction tending to reduce the obtuse angle $\theta$. As disclosed in FIG. 7, the resilient means 80 preferably comprises a length of cable 82 connected with resilient tension spring 84. The resilient means is connected with the baffle plate 70 at 86 and with the shaft 62 by connector 88. The positioning and holding means further includes a cable 90 for limiting the extent of pivotal movement of the baffle member by the resilient means 80 in a direction which would reduce the angle $\theta$. The cable 90 ends 92 and 94 are adjustably connected with the baffle and shaft members, respectively. Thus, the length of cable 90 determines the angular position at which the baffle member 70 will be positioned and held.

Prior to the mounting of the assembly in the pocket ventilation roll, the length of the cable 90 is adjusted in order to position the baffle member 70 at a desired obtuse angle $\theta$. Then, in order to insert the assembly into the inner core roll through the narrowed air inlet 49, the baffle member 70 is pivoted further toward the closed end of the inner core roll such that the obtuse angle $\theta$ increases and the distance of the baffle member top and bottom edges from the shaft decreases sufficiently to allow insertion of the assembly into the roll through the inlet 49. Once the baffle member 70 passes through the narrowed inlet 49 and into the larger portion 60 of the inner core roll, the resilient means 80 forces the baffle member to pivot back towards the air inlet and in a direction tending to reduce the obtuse angle $\theta$. The cable 90 limits the pivotal movement of the baffle member by the resilient means and positions the baffle member at the desired obtuse angle $\theta$.

Figure 15:
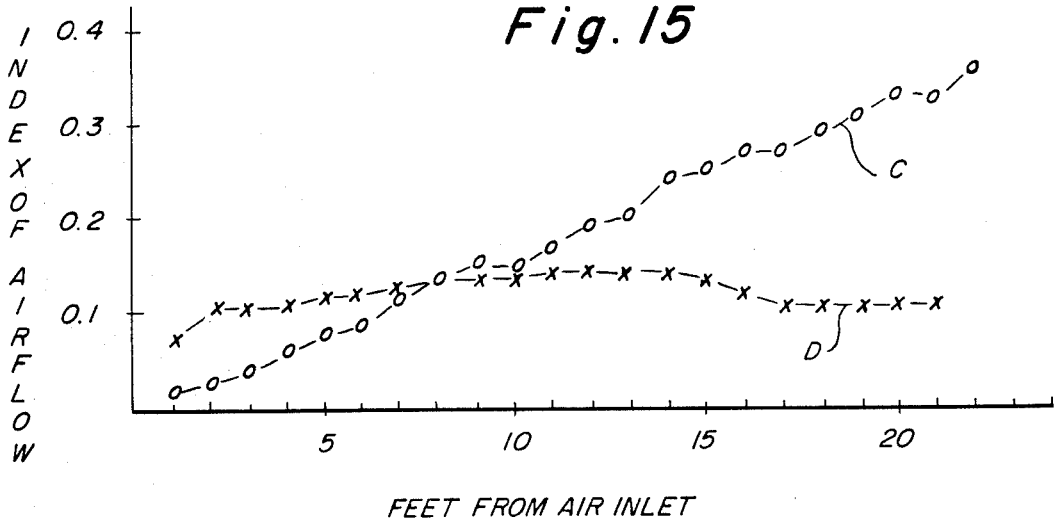
FIG. 15 discloses graphical representations of the air flow profiles exiting radially outwardly from a pocket ventilation roll with and without the use of the baffle assembly of the present invention, respectively.

FIGS. 15 and 6 disclose the actual air flow profiles and humidity profiles respectively with and without the use respectively of the baffle assembly of the present invention. More particularly, FIG. 15 discloses the radially outward air flow profile along the length of a felt covered pocket ventilation roll. Curve C represents the results obtained on a conventional pocket ventilation roll while Curve D represents the air flow profile across the length of a felt-covered pocket ventilation roll including the baffle assembly of the present invention. It is easily observed that while the pocket ventilation roll alone produces a non-uniform and greatly increasing air flow profile along the length of the roll, the baffle assembly of the present invention provides a desired symmetrical flow of air along the entire length of the pocket ventilation roll. If desired, this symmetrical flow may be made uniform.

Figure 16:
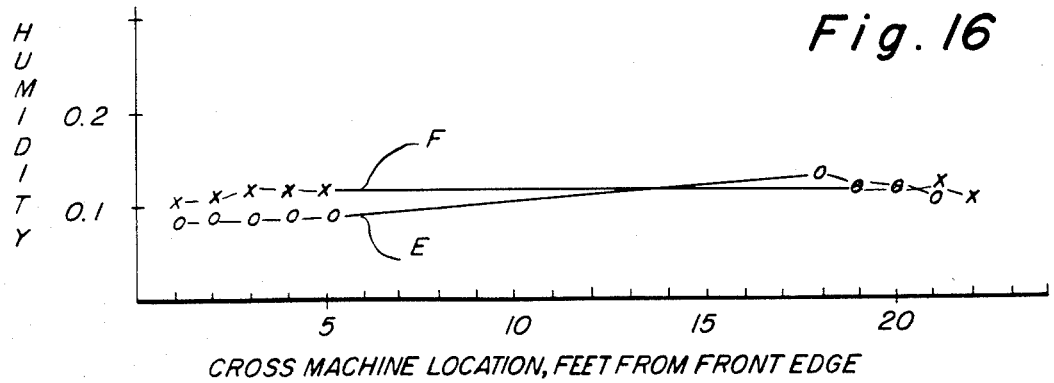
FIG. 16 discloses graphical representations of the humidity profiles in a pocket ventilation roll with and without the use of the baffle assembly of the present invention, respectively.

FIG. 16 discloses the cross-machine humidity profile in the dryer pocket adjacent the pocket ventilation roll. Similarly, Curve E represents the results obtained with a conventional pocket ventilation roll while Curve F represents the humidity profile obtained with a pocket ventilation roll including the baffle assembly of the present invention. Again, it is easily observed that the pocket ventilation roll alone causes an uneven cross-machine humidity profile. In contrast, the baffle assembly of present invention produces a relatively even and uniform cross-machine humidity profile. The uniform humidity profile produced by the present baffle assembly allows for even felt drying and the production of a paper web having a uniform cross-web moisture content.

While the preferred forms and embodiments of the invention have been illustrated and described, it will be apparent that modifications may be made without deviating from the scope of the invention set forth above.

What is claimed is:

1. In combination with a pocket ventilation roll device adapted for use in drying a paper web and including a stationary horizontal tubular inner core roll and an outer tubular shell roll mounted for rotation in concentrically spaced relation about said inner core roll, said outer shell roll being circumferentially perforated throughout its length, an arcuate portion of said inner core roll containing a plurality of longitudinally arranged perforations, said pocket ventilation roll device being closed at one end, and means for supplying drying air within said inner core roll at the other end of said pocket roll device, whereby air flows longitudinally through said inner core roll, and radially outwardly through the perforations of said inner core and outer shell roll members; baffle means for adjusting the profile of the drying air flow through said pocket ventilation roll device, comprising (a) a central shaft mounted in spaced relation longitudinally within said inner core roll;

(b) a plurality of air-deflecting baffle members located within said inner core roll and pivotally connected with said shaft at longitudinally spaced intervals for pivotal movement about parallel horizontal axes contained in planes normal to the axis of said central shaft, respectively, each of said baffle members including a planar surface for deflecting the longitudinal flow of air radially outwardly through said inner core roll perforations; and (c) means for positioning and holding said baffle members at given angular air-deflecting positions relative to said central shaft member, respectively.

2. Apparatus as defined in claim 1, wherein said given angular air-deflecting position for each baffle member is an obtuse angle relative to the direction of longitudinal flow of said drying air through said inner core roll.

3. Apparatus as defined in claim 2, wherein each of said baffle members comprises a flat plate containing a slot receiving said shaft member, the axis of said slot extending normal to the associated baffle pivot axis.

4. Apparatus as defined in claim 3, wherein at least one of said flat plate baffle members has a generally circular configuration.

5. Apparatus as defined in claim 3, wherein at least one of said flat plate baffle members has a generally eliptical configuration.

6. In combination with a pocket ventilation roll device adapted for use in drying a paper web and including a stationary horizontal tubular inner core and an outer tubular shell roll mounted for rotation in concentrically spaced relation about said inner core roll, said outer shell roll being circumferentially perforated throughout its length, an arcuate portion of said inner core roll containing a plurality of longitudinally arranged perforations, said pocket ventilation roll device being closed at one end, and means for supplying drying air within said inner core roll at the other end of said pocket roll device, whereby air flows longitudinally through said inner core roll, and radially outwardly through the perforations of said inner core and outer shell roll members;

baffle means for adjusting the profile of the drying air flow through said pocket ventilation roll device, comprising (a) a central shaft mounted in spaced relation longitudinally within said inner core roll;

(b) a plurality of air-deflecting baffle members pivotally connected with said shaft at longitudinally spaced intervals for pivotal movement about parallel horizontal axes contained in planes normal to the axis of said central shaft, respectively, each of said baffle members comprising a flat plate containing a slot receiving said shaft member, the axis of said slot extending normal to the associated baffle pivot axis; and (c) means for positioning and holding said baffle members at given angular air-deflecting positions relative to said central shaft member, respectively, said given angular air-deflecting position for each baffle member being an obtuse angle relative to the direction of longitudinal flow of said drying air through said inner core roll;

(d) the baffle member located furthermost from the air supply end of said inner core roll being larger than the remaining baffle members and of a sufficient size to substantially block the longitudinal flow of air through said inner core roll.

7. Apparatus as defined in claim 6, wherein said positioning and holding means associated with said furthermost baffle member includes resilient means biasing said baffle member in a direction tending to reduce said obtuse angle, and cable means limiting the extent of pivotal movement of said furthermost baffle member by said resilient means.

* * * * *